US010161133B2

(12) United States Patent
Tapogna

(10) Patent No.: US 10,161,133 B2
(45) Date of Patent: Dec. 25, 2018

(54) SEE THROUGH PLASTIC ROOFING PAPER SYSTEM

(71) Applicant: William Anthony Tapogna, Brooklyn, NY (US)

(72) Inventor: William Anthony Tapogna, Brooklyn, NY (US)

( * ) Notice: Subject to any disclaimer, the term of this patent is extended or adjusted under 35 U.S.C. 154(b) by 0 days.

(21) Appl. No.: 15/530,134

(22) Filed: Nov. 28, 2016

(65) Prior Publication Data

US 2018/0148932 A1 May 31, 2018

(51) Int. Cl.
*E04D 13/00* (2006.01)

(52) U.S. Cl.
CPC ..... *E04D 13/006* (2013.01)

(58) Field of Classification Search
CPC ..... E04D 13/006; G08B 21/18; G08B 21/20; G08B 21/22
USPC ..... 52/514, 514.5, 749.12; 73/40; 174/11 R; 324/694
See application file for complete search history.

(56) References Cited

U.S. PATENT DOCUMENTS 3,769,644 A * 11/1973 Case ..... B25F 1/00 254/26 R
4,598,273 A * 7/1986 Bryan, Jr. ..... E04D 13/006 200/61.04
4,748,847 A * 6/1988 Sheahan ..... G01M 3/20 73/40.7
5,081,422 A * 1/1992 Shih ..... E04D 13/006 324/693
8,180,495 B1 * 5/2012 Roy ..... H05K 7/20745 165/67
2005/0076597 A1 * 4/2005 Ridenour ..... E04D 13/00 52/514
2009/0044595 A1 * 2/2009 Vokey ..... E04D 13/006 73/1.17
2010/0127848 A1 * 5/2010 Mustapha ..... G08B 21/20 340/505

* cited by examiner

*Primary Examiner* — William V Gilbert

(57) ABSTRACT

This embodiment specifically pertains to the field of roofing to find roof leaks or problems fast and easy. This idea and components can find the exact location of a leak in a matter of seconds by simply looking through the paper. See-through paper can turn a do-it-yourselfer into a professional instantly to find leaks from water, gas, or related roofing problems or any roof; flat or pitched. This two layer system, plastic (clear) (FIG. 1) and blotter-paper (FIG. 2), allows leaks to finally be seen as they happen and will stop them in their tracks. Optionally wireless pressure sensitive pads (FIG. 3) alerts owners of buildings or authorities to IPhones or laptop computers of fires, sparks, or intruders. A repair kit (FIG. 4) allows amateurs or professionals to seal and repair roof leaks. Kit includes caulking, clear adhesive, 2 hand rollers, and one pointy trowel.

1 Claim, 5 Drawing Sheets

SEE THROUGH PLASTIC ROOFING PAPER SYSTEM

FIELD OF THE INVENTION

The present invention pertains to the field of roofing, and more specifically to the field of determining damage sources of roof leaks.

BACKGROUND OF THE INVENTION

The prior art has put forth several designs for determining damage sources of roof leaks. Among these are:

U.S. Pat. No. 5,081,422 to Ishiang Shih describes a method to detect leaks in a roof or leaks in basement walls or floors of a building. The detection is achieved by placing a two wire detector in the region to be monitored and measuring the current with a voltage applied across the two wires. The location of the leak is determined by placing several wire detector pairs in a mesh fashion and then scanning the leakage current through each wire pair. A complete detection and scanning system is also described.

U.S. Pat. No. 4,748,847 to James P. Sheahan describes a method of detecting leaks in a multilayered roof system comprising ejecting a tracer gas and a propellant gas under a water impermeable membrane of a multi layered roof system and detecting any escape of the tracer gas on the surface of the roof, which detection is indicative of a break or opening in the water-impermeable membrane.

U.S. Pat. No. 4,598,273 to Bynum O. Bryan, Jr. and Earl Seagrave describes a moisture intrusion detection system wherein a plurality of independent and insular moisture detecting devices are placed in a predetermined spaced apart relationship across the surface of a roof structure, or other system incorporating a water impermeable membrane, beneath the water impermeable membrane thereof. Each of the detecting devices includes a moisture detecting and power supply component and signaling component. When moisture penetrates the water impermeable membrane of the roof structure, a leak condition exists and a water activated battery is activated. Each detecting device in contact with water is activated. In combination with the detecting devices, position and direction locator apparatus are used in combination with the detecting devices to localize the source of the leak and the extent of any water damage caused thereby.

None of these prior art references describe the present invention.

SUMMARY OF THE INVENTION

It is an object of the present invention to provide a roofing repair kit specifically configured to detect an exact location of a leak and provide an instantly accessible means of correcting the problem.

DETAILED DESCRIPTION OF THE INVENTION

Figure 1:
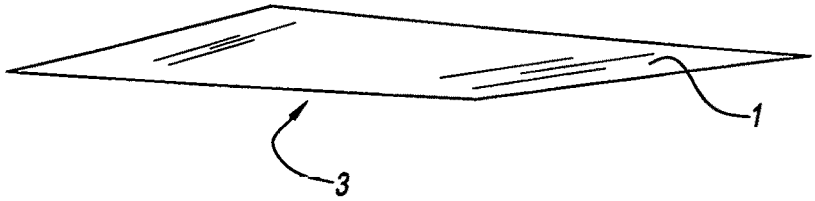
FIG. 1 is a prototypical standalone view of a component of the present invention, a strong sheet of plastic paper which is thin and transparent.

FIG. 1 is a prototypical standalone view of a component of the present invention, a strong sheet of plastic paper which is thin and transparent. FIG. 1 shows a number 1 on it that is a piece of the See Through Plastic Paper this is where you cut off the repair patch from a new roll (not shown) to make the repair by gluing the newly found hole in the roof at the point of where the leak is to be repaired.

Figure 4:
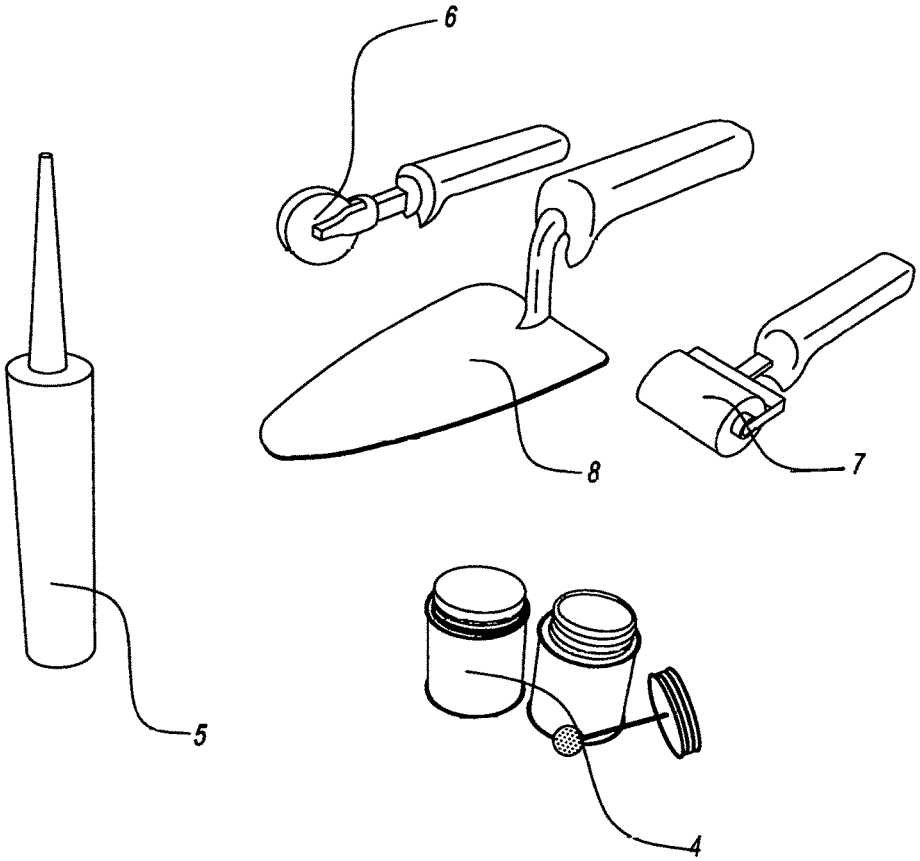
FIG. 4 is a prototypical view of included accessories for the present invention such as a nonflammable adhesive, a tube of silicone, a trowel, a stitcher and a hand roller.

FIG. 1 has a number 3 also which is where a piece of White Blotter Paper Element #3 has been added (not shown) that has been cut from a separate roll of White Blotter Paper to be placed under the Clear Plastic Roofing Paper that is the under layer to the top surface. Once these two sheets have been cut and placed into the damaged area they need to be glued and caulked with the provided cans of glue and tube of caulking to seal the repair and make a finished patch where the damage has occurred. All repairs are to be made with the tools in FIG. 4 which include two cans of glue numbered element number 4 also one tube of caulking numbered element number 5 also one hand roller stitcher numbered element number 6 also one wide hand roller numbered element number 7 and last a flat pointy hand trowel numbered element number 8. These tools are all the tools except for a small utility knife (not included) in the repair kit for child protection that is all the tools you will need to make a complete repair to any section of your roof.

Figure 2:
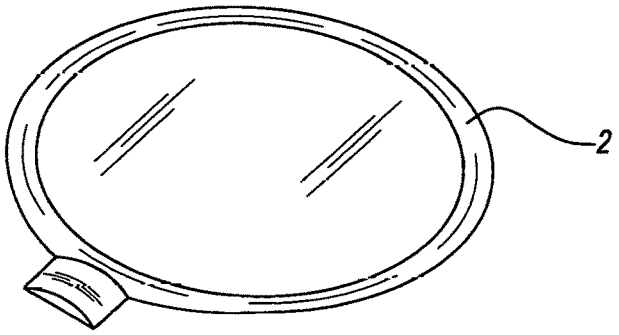
FIG. 2 is a prototypical standalone view of a component of the present invention, a wireless sensor pad that is pressure sensitive.
Figure 3:
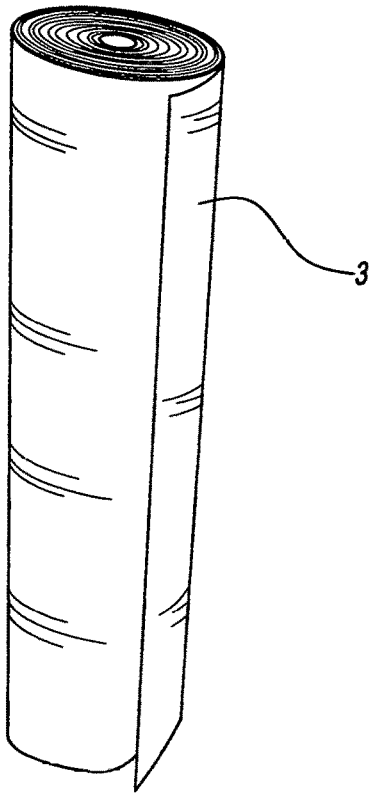
FIG. 3 is a prototypical standalone view of a component of the present invention, a roll of a white blotter paper that is an absorbent material.
Figure 5:
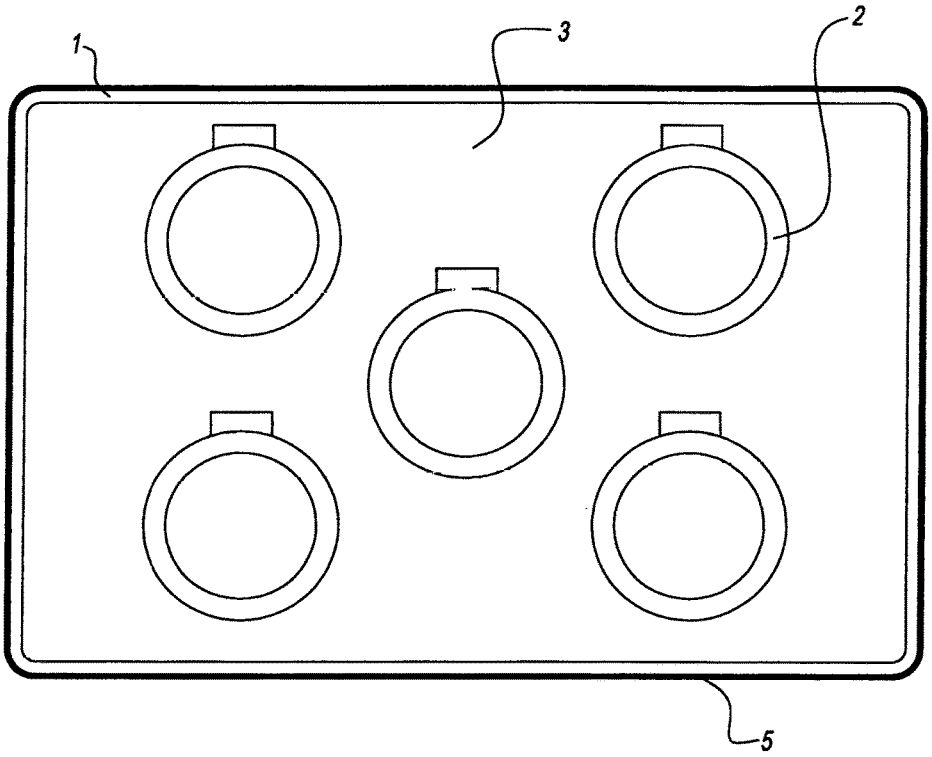
FIG. 5 is a prototypical view of an assembly of the plastic paper and sensor pad.

The FIG. 2 the wireless sensor that is placed under the two top layers of the roofing paper is numbered element number 2. This sensor works along with reporting any leaks when water passes over it or close enough to it to detect any leaks of water, gas, electrical sparks, or any intruders on the roof. FIG. 3 The roll of White Blotter Paper, numbered element number 3, is basically used for the purpose of repairing damage to roof and as the bottom layer to see leaks which discolor the blotter paper when a leak occurs under the Plastic top layer. FIG. 3 numbered element number 3 is a roll of felt paper used to cut a patch off the main roll and make any repair using all tools in FIG. 4 elements numbered 4 thru 8. The White Blotter Paper is an absorbent which is FIG. 3 numbered element number 3 if need be this paper can also help make any repair and to dry roof area needed to be patched properly to make a patch and seal all leaks. FIG. 5 is a standalone prototypical view of a fully repaired patch to any roof.

The invention claimed is:

1. A product for detecting a leak in a roof, comprising:

a section of transparent plastic sheeting having an upper surface and a lower surface, said lower surface having an adhesive configured to attach said section of transparent plastic to said roof, said section of transparent plastic sheeting being nonflammable;

a section of white blotting paper attached to a lower surface of said section of said transparent plastic, said white blotting paper configured to indicate moisture when said moisture contacts said white blotting paper;

said section of transparent plastic and said section of white blotting paper defining a patch;

a moisture sensor pad configured to be placed between said patch and said roof, said moisture sensor being wireless; and, a receiver configured to receive a signal from said moisture sensor pad when said moisture sensor pad detects the presence of moisture.

* * * * *